US008884501B2

(12) United States Patent
Cho et al.

(10) Patent No.: US 8,884,501 B2
(45) Date of Patent: Nov. 11, 2014

(54) LED BASED LAMP AND METHOD FOR MANUFACTURING THE SAME

(75) Inventors: Hankyu Cho, Seoul (KR); Hyunha Kim, Seoul (KR); Euna Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/016,310

(22) Filed: Jan. 28, 2011

(65) Prior Publication Data

US 2012/0001531 A1 Jan. 5, 2012

(30) Foreign Application Priority Data

Jun. 30, 2010 (KR) ..... 10-2010-0062951

(51) Int. Cl.

| | |
|---|---|
| ***H01J 61/52*** | (2006.01) |
| ***H01K 1/30*** | (2006.01) |
| ***F21K 99/00*** | (2010.01) |
| ***F21V 29/00*** | (2006.01) |
| ***F21V 5/04*** | (2006.01) |
| ***F21V 5/00*** | (2006.01) |
| ***F21V 3/04*** | (2006.01) |
| *F21V 19/00* | (2006.01) |
| *F21V 15/01* | (2006.01) |
| *F21Y 101/02* | (2006.01) |

(52) U.S. Cl.

CPC ..... *F21V 5/002* (2013.01); *F21V 19/0055* (2013.01); *F21K 9/137* (2013.01); *F21V 29/246* (2013.01); *F21V 29/2206* (2013.01); *F21V 5/04* (2013.01); *F21V 15/011* (2013.01); *F21Y 2101/02* (2013.01); *F21V 3/04* (2013.01)

USPC ..... 313/46; 362/375; 313/310

(58) Field of Classification Search

USPC ..... 362/375, 327

See application file for complete search history.

(56) References Cited

U.S. PATENT DOCUMENTS

| | | | | |
|---|---|---|---|---|
| 1,456,585 | A * | 5/1923 | Bell | 362/335 |
| 4,207,607 | A * | 6/1980 | Gulliksen | 362/282 |
| 5,722,760 | A | 3/1998 | Chien | |
| 5,940,269 | A | 8/1999 | Ko et al. | |
| 6,331,063 | B1 | 12/2001 | Kamada et al. | |

(Continued)

FOREIGN PATENT DOCUMENTS

| | | |
|---|---|---|
| JP | 2004-179048 | 6/2004 |
| JP | 2006-48165 | 2/2006 |

(Continued)

OTHER PUBLICATIONS

Office Action dated Oct. 27, 2011 for U.S. Appl. No. 13/099,890.

(Continued)

*Primary Examiner* — Nimeshkumar Patel
*Assistant Examiner* — Jacob R Stern
(74) *Attorney, Agent, or Firm* — KED & Associates LLP

(57) ABSTRACT

A light emitting diode (LED) based lamp is provided that may include a housing, a LED module having at least one LED to emit light, and a lens to receive the light from the LED and to guide the light to a specific area. An outer circumference of the lens may have a different surface roughness than an inner surface of the lens or may have a different light transmissivity than the inner surface of the lens. The outer circumference of the lens may minimize light from being transmitted to a region outside the specific area.

17 Claims, 7 Drawing Sheets

(56) References Cited

U.S. PATENT DOCUMENTS

| | | | | |
|---|---|---|---|---|
| 6,367,949 | B1 | 4/2002 | Pederson | |
| 6,461,024 | B1 * | 10/2002 | Becker et al. | 362/331 |
| 6,599,002 | B2 * | 7/2003 | Hsieh et al. | 362/555 |
| 7,134,769 | B2 * | 11/2006 | Rohlfing et al. | 362/331 |
| 7,322,718 | B2 | 1/2008 | Setomoto et al. | |
| 7,404,658 | B1 | 7/2008 | Lyons et al. | |
| 7,614,769 | B2 | 11/2009 | Sell | |
| 7,628,513 | B2 * | 12/2009 | Chiu | 362/311.02 |
| 7,686,486 | B2 * | 3/2010 | Tessnow et al. | 362/487 |
| 7,780,317 | B2 * | 8/2010 | Schroll et al. | 362/309 |
| 7,821,380 | B1 | 10/2010 | Grote, Jr. | |
| 7,988,335 | B2 | 8/2011 | Liu et al. | |
| 8,042,969 | B2 * | 10/2011 | Paik et al. | 362/241 |
| 8,052,301 | B2 | 11/2011 | Zhou et al. | |
| 8,087,807 | B2 | 1/2012 | Liu et al. | |
| 8,206,015 | B2 * | 6/2012 | Cho et al. | 362/311.02 |
| 2002/0024822 | A1 * | 2/2002 | Pond et al. | 362/555 |
| 2004/0066142 | A1 | 4/2004 | Stimac | |
| 2005/0128752 | A1 | 6/2005 | Ewington | |
| 2006/0044806 | A1 * | 3/2006 | Abramov et al. | 362/337 |
| 2006/0092641 | A1 | 5/2006 | Phelan et al. | |
| 2008/0078524 | A1 | 4/2008 | Wilcox et al. | |
| 2008/0080162 | A1 | 4/2008 | Wilcox et al. | |
| 2008/0123331 | A1 * | 5/2008 | Schroll et al. | 362/231 |
| 2009/0003009 | A1 * | 1/2009 | Tessnow et al. | 362/487 |
| 2009/0129102 | A1 | 5/2009 | Xiao et al. | |
| 2009/0141508 | A1 * | 6/2009 | Peng et al. | 362/373 |
| 2009/0184619 | A1 | 7/2009 | Lai | |
| 2009/0290352 | A1 | 11/2009 | Wu et al. | |
| 2010/0214788 | A1 * | 8/2010 | Kadono et al. | 362/311.01 |
| 2011/0063832 | A1 | 3/2011 | Hu et al. | |
| 2011/0110046 | A1 | 5/2011 | Itoh et al. | |
| 2011/0181167 | A1 * | 7/2011 | Cho et al. | 313/46 |
| 2011/0194282 | A1 * | 8/2011 | Paik et al. | 362/245 |
| 2011/0317412 | A1 * | 12/2011 | Paik et al. | 362/235 |
| 2011/0317428 | A1 * | 12/2011 | Paik et al. | 362/294 |
| 2012/0001531 | A1 * | 1/2012 | Cho et al. | 313/46 |
| 2012/0002424 | A1 * | 1/2012 | Cho et al. | 362/294 |
| 2012/0026740 | A1 * | 2/2012 | Kim et al. | 362/294 |
| 2012/0033423 | A1 * | 2/2012 | Kim et al. | 362/235 |
| 2012/0074835 | A1 * | 3/2012 | Piquette et al. | 313/501 |
| 2012/0106152 | A1 | 5/2012 | Zheng et al. | |
| 2012/0106167 | A1 * | 5/2012 | Chang | 362/311.02 |
| 2012/0120667 | A1 * | 5/2012 | Schenkl | 362/335 |
| 2012/0176801 | A1 * | 7/2012 | You | 362/311.02 |

FOREIGN PATENT DOCUMENTS

| | | |
|---|---|---|
| JP | 2009-048994 | 3/2009 |
| KR | 20-0353040 | 6/2004 |
| KR | 10-2006-0086177 | 7/2006 |
| KR | 10-2006-0104501 | 10/2006 |
| KR | 10-0695542 | 3/2007 |
| KR | 10-2007-0044022 | 4/2007 |
| KR | 10-0715039 | 5/2007 |
| KR | 2008-0020614 | 3/2008 |
| KR | 20-2008-0002564 | 7/2008 |
| KR | 10-2008-0093284 | 10/2008 |
| KR | 10-2009-0004569 | 1/2009 |
| KR | 10-2009-0042679 | 4/2009 |
| KR | 10-0896381 | 4/2009 |
| KR | 20-2009-0004396 | 5/2009 |
| KR | 2009-0097055 | 9/2009 |
| KR | 20-0447377 | 1/2010 |
| KR | 10-2010-0026422 | 3/2010 |
| KR | 10-2010-0030683 | 3/2010 |
| KR | 10-2010-0035934 | 4/2010 |
| KR | 10-2010-0055320 | 5/2010 |
| KR | 10-2010-006685 | 6/2010 |
| KR | 10-2010-0064800 | 6/2010 |
| KR | 10-2010-0066685 | 6/2010 |
| KR | 10-0967946 | 7/2010 |
| KR | 10-2011-0029915 | 3/2011 |
| WO | WO 2009/065389 | 5/2009 |

OTHER PUBLICATIONS

Korean Notice of Allowance for Application 10-2010-0059559 dated Jul. 11, 2011.

Korean Notice of Allowance for Application 10-2010-0062951 dated Jul. 28, 2011.

Notice of Allowance dated Feb. 21, 2012 for U.S. Appl. No. 13/099,890.

Korean Prior Art Search Report for Application 10-2010-0062951 dated Mar. 31, 2011.

Korean Office Action for Application 10-2010-0062951 dated Apr. 22, 2011.

Korean Office Action for Application 10-2010-0059559 dated Apr. 15, 2011.

Korean Prior Art Search Report for Application 10-2010-0059559 dated Mar. 30, 2011.

Korean Prior Art Search Report for Application 10-2010-0063728 dated Mar. 31, 2011.

Office Action for U.S. Appl. No. 13/040,608 dated Sep. 13, 2012.

European Search Report for Application 11159284.6 dated Sep. 12, 2012.

U.S. Office Action dated Feb. 14, 2013 for U.S. Appl. No. 13/040,608.

U.S. Office Action dated Apr. 3, 2013 for U.S. Appl. No. 13/081,023.

U.S. Office Action for U.S. Appl. No. 13/040,608 dated Jun. 4, 2013.

* cited by examiner (a)

(b)

LED BASED LAMP AND METHOD FOR MANUFACTURING THE SAME

CROSS-REFERENCE TO RELATED APPLICATION

This application claims priority from Korean Application No. 10-2010-0062951 filed Jun. 30, 2010, the subject matter of which is incorporated herein by reference.

BACKGROUND

1. Field

Embodiments of the present invention may relate to a lamp and a method for manufacturing the same.

2. Background

An incandescent lamp, a halogen lamp, a discharge lamp and/or the like have been used as a lamp. A Light Emitting Diode (LED) has also been used. LED based lamps may use an LED member as a light source. The LED member may emit a light as minority carriers injected, by using a semiconductor P-N junction structure, are generated and re-coupled again. Light from the LED member may have a wavelength that varies based on kinds of impurities added thereto, thereby enabling the LED member to emit a red color, a blue color, and/or a yellow color, and to produce a white color by an appropriate combination of the colors. The LED member may be advantageous in that the LED member may have a smaller size, a longer lifetime, a better efficiency, and/or a faster response than a light source such as the incandescent lamp, and/or the halogen lamp.

If an LED based lamp is used as a mere lighting, a direction of the light may be offset by using a non-transparent diffusion cap. If the direction of the light is required for a particular purpose, a lens structure may guide the light from the LED member in a particular direction.

The LED based lamp having a directional light may have a lens unit (or lens) or a combination of a lens unit and a reflector. By using the lens unit and the reflector, light from the LED member may have a direction that is incident on a desired region.

As shown in FIG. 1, in an LED based lamp according to an arrangement, even if a lens unit and a reflector are designed such that the LED based lamp has a certain light incident region B, it may be difficult to avoid a phenomenon in which light is incident on an outside region BS of the intended light incident region B. The light incident on the outside region BS may have a star shape, as shown in FIG. 1. This LED based lamp may have a problem in that a light distribution and a total flux of light may become poor due to the light BS incident on an unintended region.

BRIEF DESCRIPTION OF THE DRAWINGS

Arrangements and embodiments may be described in detail with reference to the following drawings in which like reference numerals refer to like elements and wherein.

DETAILED DESCRIPTION

Reference may now be made in detail to specific arrangements and embodiments of the present invention, examples of which may be illustrated in the accompanying drawings. Wherever possible, same reference numbers may be used throughout the drawings to refer to the same or like parts. The LED based lamp described below may be exemplary, as other types of LED based lamps may also be provided.

Figure 2:
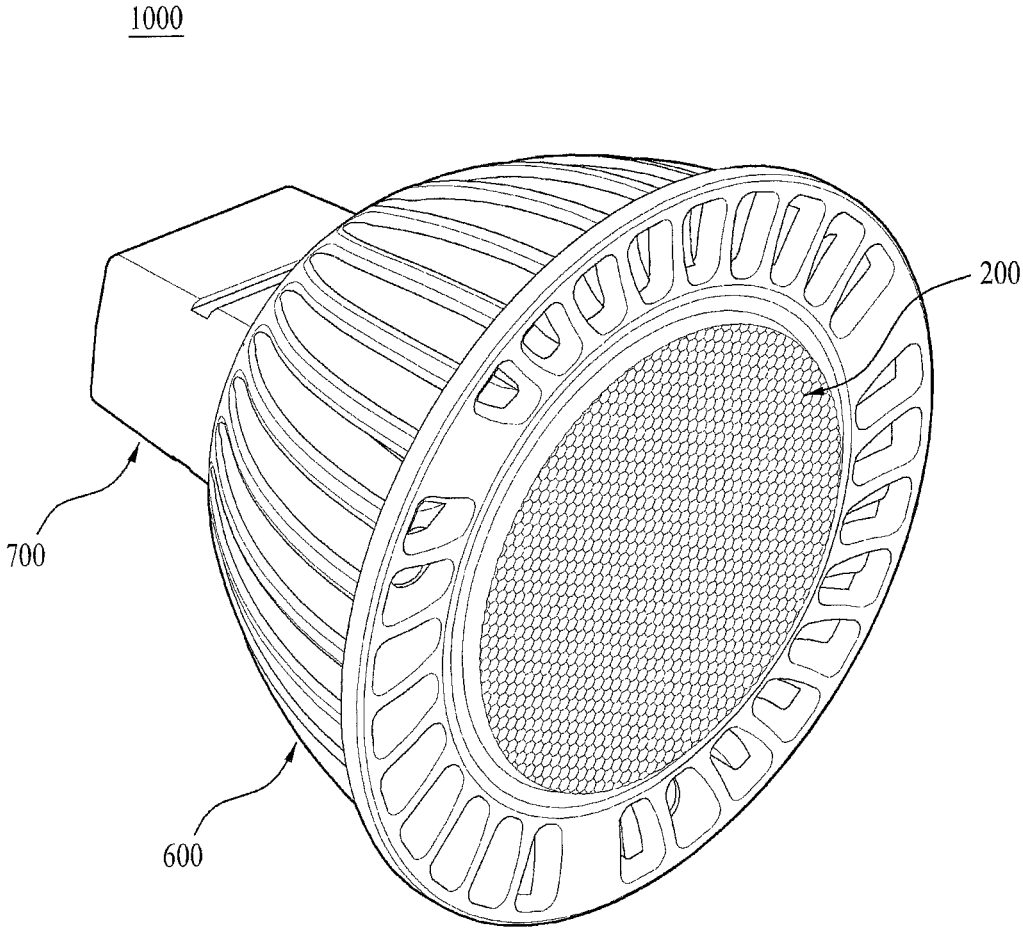
FIG. 2 shows a configuration of an LED based lamp in accordance with an example embodiment of the present invention.
Figure 3:
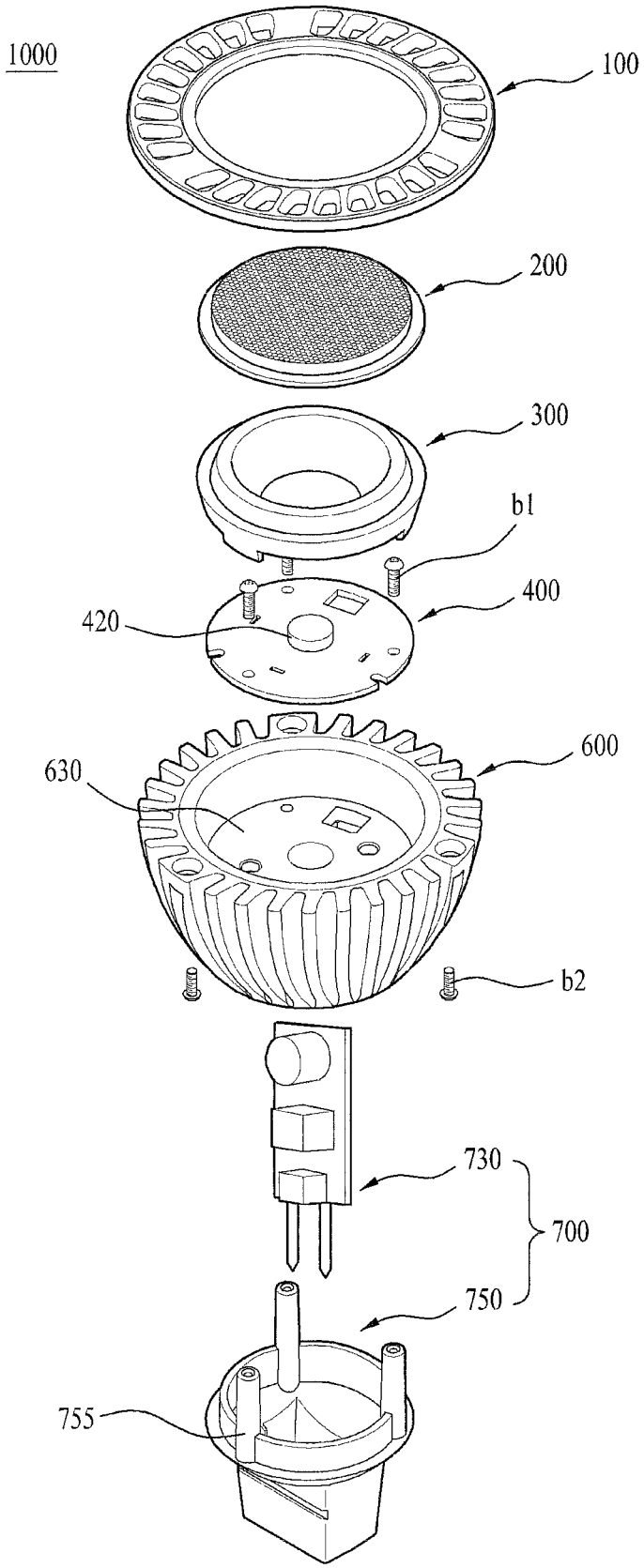
FIG. 3 is an exploded view of FIG. 2.
Figure 4:
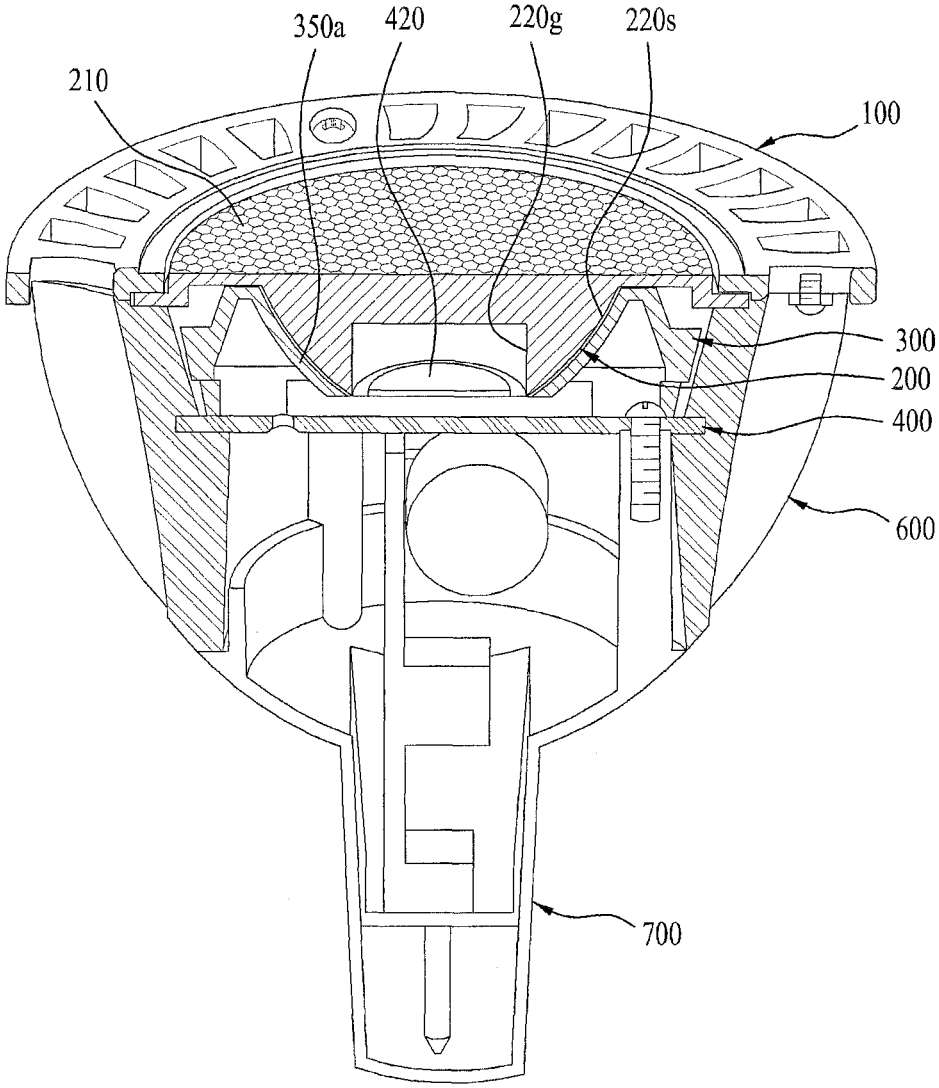
FIG. 4 illustrates a section of an assembly of FIG. 2.

FIG. 2 shows a configuration of an LED based lamp in accordance with an example embodiment of the present invention. FIG. 3 is an exploded view of FIG. 2. FIG. 4 illustrates a section of an assembly of FIG. 2. Other embodiments and configurations may also be provided.

FIG. 2 shows an LED based lamp 1000 that includes a housing 600 (or heat sink), a lens unit 200 (or lens) and a base 700. The lens unit 200 may be provided in front of the housing 600 where an LED module 400 is provided thereto. The lens unit 200 may induce a light from the LED module 400 to be directed to a predetermined light incident region at a predetermined light incident angle. The base 700 may be provided in rear of the housing 600. The base 700 may have an electric unit for supplying power to the LED module 400, and for transmitting a control signal to the LED module 400.

The LED module 400 may have an LED 420 (or LED member) that generates heat during operation. The LED module 400 may be mounted in the housing 600. The housing 600 may have a receiving part 630 of a predetermined shape. The LED module 400 may be provided in the receiving part 630 with a fastening member, such as a bolt b1. In order to effectively dissipate heat from the LED module 400, the housing 600 may be formed of metal. Heat dissipation fins (or cooling fins) may be provided on an outside surface of the housing 600.

The lens unit 200 may be provided in front of the LED module 400 (i.e., an upper side of FIG. 3). The lens unit 200 may induce the light from the LED 420 to be directed to a predetermined light incident region. The lens unit 200 may use a total reflection for directing the light to a desired light incident region. A plastic lens, having a roughness of a few tens of nanometers to a few hundreds of nanometers, may not make total reflection of the light from the LED 420, but rather may transmit a portion thereof. Consequently, a reflector 300 may surround an outside of the lens unit 200 for re-reflecting a small quantity of the light that is partially transmitted. The lens unit 200 and the reflector 300 may be coupled to the housing 600 with a covering 100.

The base 700 may be coupled to a rear of the housing 600 (i.e., a lower side of FIG. 3). The base 700 may include an electric unit 730 for transforming external power to a power to be used for the LED module 400, and a housing 750 for housing the electric unit 730. The LED module 400 may use AC or DC, and/or various magnitudes of voltages. Therefore, an AC-DC converter for converting current, and a transformer for regulating a magnitude of the voltage may be provided in the electric unit 730. The housing 750 may have fastening bosses 755 for coupling the housing 600 to the housing 750 by fastening the fastening bosses 755 to the housing 600 with bolts b2, respectively.

Figure 5:
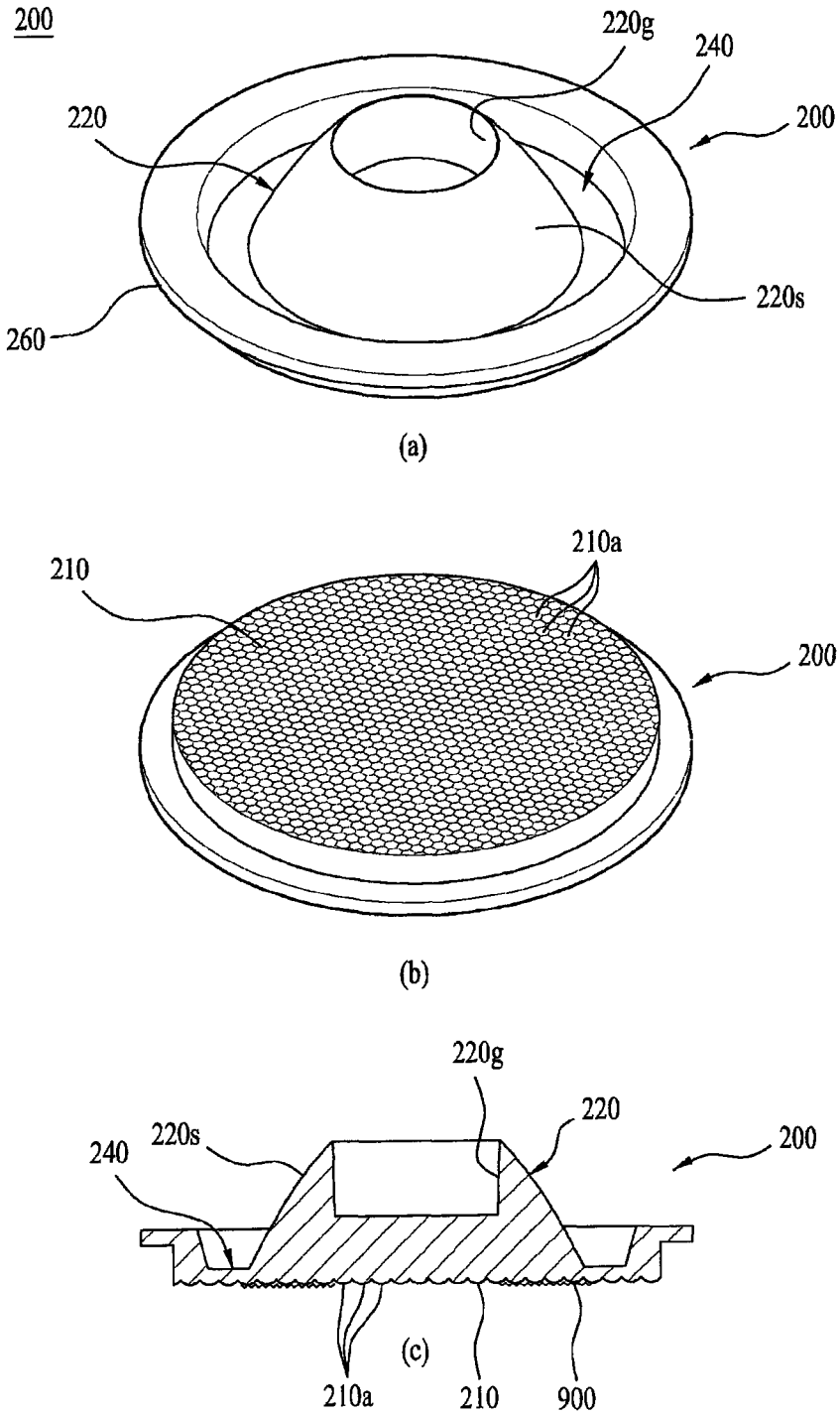
FIGS. 5(*a*), 5(*b*), and 5(*c*) illustrate a rear side view, a front side view, and a sectional view of the lens unit in FIG. 2, respectively.

The lens unit 200 may be described with reference to FIG. 5. FIG. 5(*a*) illustrates a rear side view of the lens unit 200, FIG. 5(*b*) illustrates a front side view of the lens unit 200, and FIG. 5(*c*) illustrates a sectional view of the lens unit 200.

The lens unit 200 may include a lens 220 for receiving light from the LED 420 and for guiding the light to a specific area. The lens unit 200 may also include a window 240 (or part) that is an outward extension from a circumference of the lens 220.

The lens 220 may project toward the LED module 400. The lens 220 may have a hollow part 220*g* for providing the LED 420 therein, and an outside surface that is a sloped surface 220*s* with a predetermined curvature for making a total reflection of the light. A front surface of the lens unit 200 may be a light emission surface 210, and the light emission surface 210 may have a microlens array 210*a*. The microlens array 210*a* may be a plurality of micron sized lenses provided to a light emission surface 210. The microlens array 210*a* provided to the light emission surface 210 may increase light distribution efficiency and improve a quality of emitted light.

An adjustor 900, as shown in FIG. 5(*c*), may also be provided in order to minimize the light incident on a region other than a defined light incident region.

The LED 420 of the LED module 400 may have the hollow part 220*g* provided therein, for making the light from the LED 420 to be incident on the hollow part 220*g*. The light incident on the hollow part 220*g* may be totally reflected at the sloped surface 220*s* so as to be directed to the light emission surface 210. That is, the total reflection at the sloped surface 220*s* may make the light from the LED 420 to be directed to a desired light incident region. However, since the total reflection of the entire light may actually be difficult, the reflector 300 may be used for surrounding an outside of the lens unit 200.

Since the window 240 is not a region on which the light from the LED 420 is directly incident, the window 240 may not have any particular lens function. The window 240 may be a part used for entire sizes of the lens unit 200 and may be standardized for convenience of assembly. However, light transmitted through the lens unit 220 and irregularly reflected at or scattered from the reflector 300 may be incident on the window 420.

Figure 6:
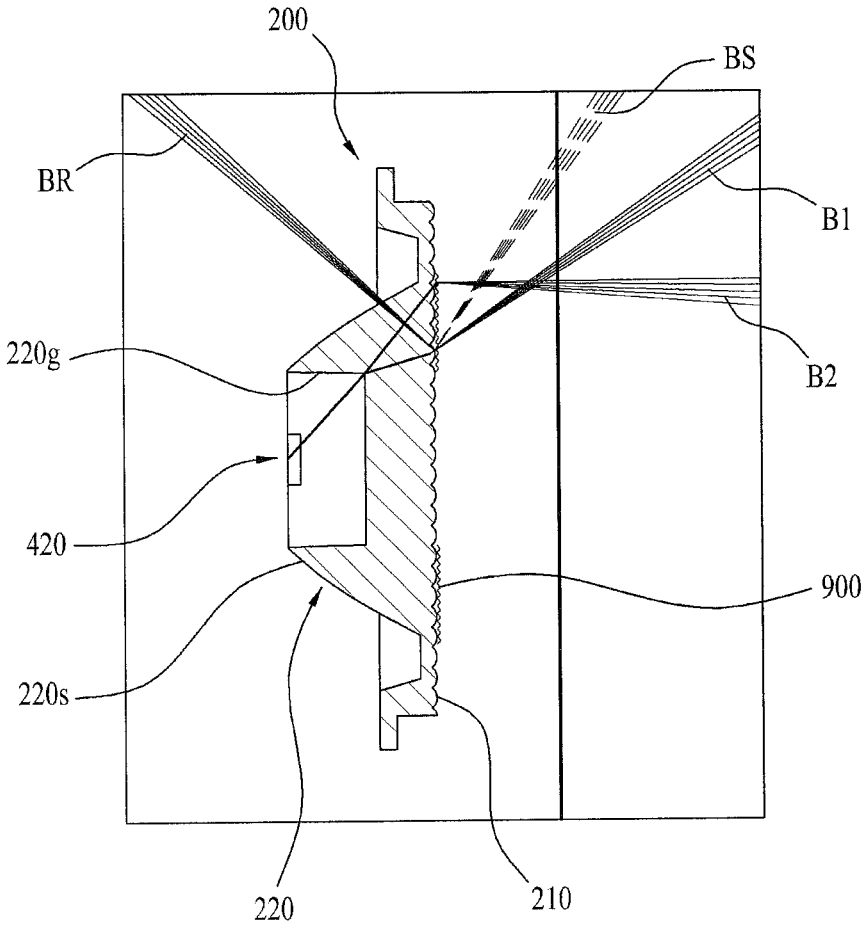
FIG. 6 illustrates a schematic view of an operation principle of an LED based lamp in accordance with an example embodiment of the present invention.

FIG. 6 shows the adjustor 900 that may minimize light incident on a region other than the defined light incident region, as may be described in further detail. For ease of description, FIG. 6 illustrates only one stream of the light from the LED 420.

Light B1, B2 and BS from the LED 420 may be guided by the lens unit 200. The light BR reflected at a part of the light emission surface 210 may be returned after re-reflected at the sloped surface 220*s* of the lens 220 or may be reflected by the reflector 900.

Figure 1:
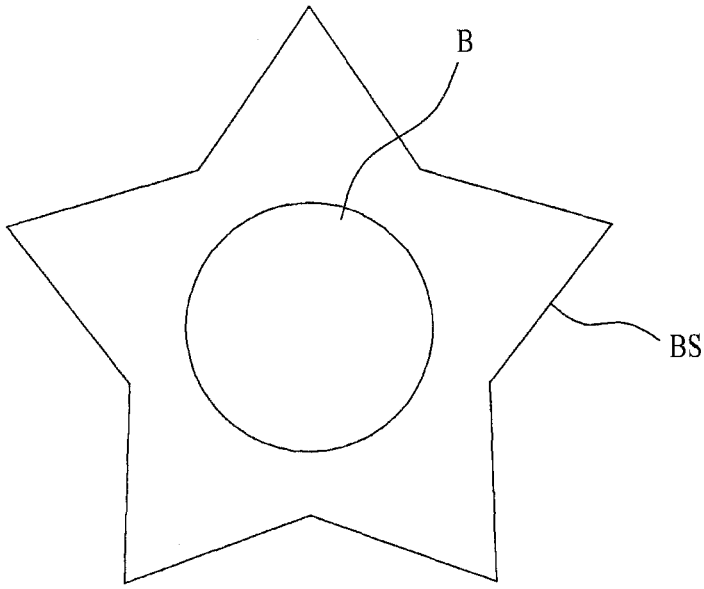
FIG. 1 illustrates a view of light distribution of an LED based lamp.

Since the lens unit 200 may be designed to make the light to be incident on the defined incident region (i.e., a desired incident region), the light through the lens 200 may be incident on the defined light incident region. However, as described with respect to FIG. 1, a light may be incident on the light incident region B1 and B2 and a light BS may be incident on a region away from the light incident region, so as to form a star shaped light on an outside of the light incident region. This may be due to refraction of a light of a certain wavelength to outside of the defined light incident region. This may be affected based on micron roughness of a surface of the lens 220 formed at a time of manufacturing the lens unit 200.

Embodiments of the present invention may provide the adjustor 900 on a predetermined position of the lens unit 200 for minimizing light emitting from the light emission surface 210 of the lens unit 200, to prevent the light BS from being incident to outside of the light incident region. The adjustor 900 may be provided on the lens 220 to minimize light from being transmitted to a region outside of a specific area. The adjustor 900 may have a different surface roughness than an inner surface of the lens 220. The adjustor 900 may also have a different light transmissivity than the inner surface of the lens 220. The adjuster 900 may be considered as part of the lens unit 200.

The unintended light BS may cause a problem at a boundary of the defined light incident region because the light within the light incident region may be included to a range of the light incident region again even when a portion thereof refracts. The adjustor 900 may be positioned at a boundary of the light incident region, and more preferably in a ring shape. If the window 240 is provided to the lens unit 200, since there are many cases of undesired light emission from the boundary between the lens 220 and the window 240, the adjustor 900 may include the window 240. Locations at which the adjustor 900 may be positioned are not limited to above, but may be determined according to simulation or experiment in view of a nature of the light. For example, the adjustor 900 may be positioned at a particular position of the lens 220.

Types of the adjustor 900 are not limited, since the adjustor 900 is merely one type of device to prevent light from emitting to an outside of the light incident region. The adjustor 900 may have parts with micron unevenness (i.e., a micron surface roughness relatively greater than the surface roughness of the lens unit 200) because a plurality of the micron uneven parts may be formed by polishing or sand blasting. At the time of manufacturing the lens unit 200, a relevant part of a mold of the lens unit 200 may be sand blasted to form the micron unevenness at the adjustor 900 when the lens unit 200 is molded with the mold sand blasted at the end. The uneven part may be provided to at least one of a front surface and a rear surface of the lens unit 200. This configuration may minimize emission of the light to outside of the light incident region as the light takes another path (i.e., an inside of the light incident region) during which the light repeats reflection and refraction within the adjustor 900 without going to an outside of the light emission surface, but returning into the lens unit 200 again owing to a relatively greater surface roughness of the adjustor 900 than the other part of the lens unit 200.

Although the surface roughness of the adjustor 900 may not be defined, the surface roughness may be selected such that a total flux of light is not reduced while the unintended emission of the light is prevented. According to a study, even though the total flux of light is reduced by more than approximately 4% if the micron unevenness is a few hundreds of microns compared to an example when there is no change of the surface roughness, the total flux of light may be reduced by below approximately 0.6% when the micron unevenness is a few tens of microns compared to an example when there is no change of the surface roughness. Therefore, reduction of the total flux of light may be minimized by appropriate selection of the surface roughness. Additionally, an entire lens unit may have a predetermined surface roughness without limiting to the adjustor 900. This may permit easy manufacturing of the lens unit 200. In this example, the front surface and/or the rear surface of the lens unit 200 may also have a predetermined surface roughness.

Production of the adjustor 900 may not be limited to a change of the surface roughness. For example, by making light transmissivity of the adjustor 900 smaller than the other part of the lens unit 200, light emission through this part may also be minimized. For example, the adjustor 900 may be made not to actually transmit the light. The adjustor 900 may absorb or reflect the light to a certain extent. If the adjustor 900 absorbs the light, since adjustor 900 is liable to absorb the light re-reflected also at the reflector, reducing the total flux of light, the adjustor 900 may also reflect the light.

Although the above description relates to the adjustor 900 being formed as one unit with the lens unit 200, embodiments of the present invention are not limited to this. The manufacturing of the adjustor 900 as a separate member and appropriate coupling of the adjustor 900 with the lens unit 200 may also be provided.

Figure 7:
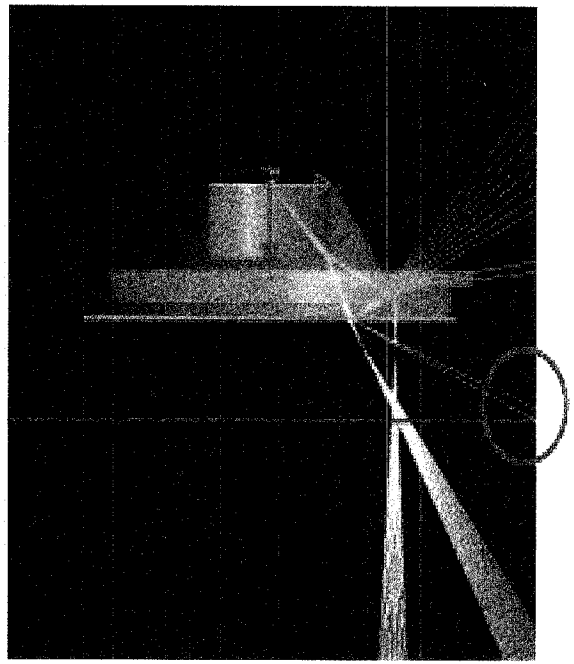
FIGS. 7(*a*) and 7(*b*) illustrate photographs showing operations of an LED based lamp according to an arrangement and an LED based lamp in accordance with an example embodiment of the present invention, respectively.
Figure 7:
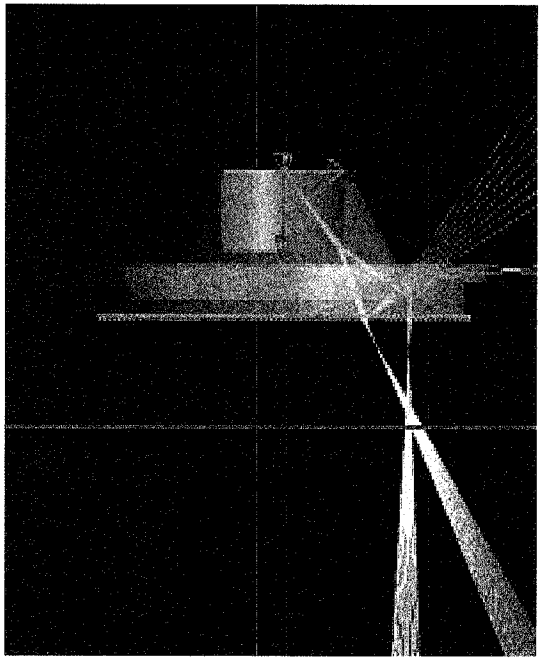

Operation of the LED based lamp in accordance with an example embodiment may be described with reference to FIGS. 7(*a*) and 7(*b*). FIG. 7(*a*) illustrates a lens unit without sand blasting, and FIG. 7(*b*) illustrates a lens unit with sand blasting.

As can be seen from FIG. 7(*a*), if an adjustor is not provided to the lens unit 220 by a type like sand blasting, an undesired star shaped light may take place on a side of the lens unit 220. However, as can be seen from FIG. 7(*b*), if the adjustor 900 is provided to the lens unit 220 by a type like sand blasting, the adjustor 900 may prevent the star shaped light from taking place. Moreover, the adjustor 900 may make no reduction of the total flux of light because light of which emission to outside of the light incident region may be prevented by the adjustor 900 can be emitted to the light incident region again by the lens 220 and the reflector 300.

An LED based lamp and a method for manufacturing the same of the present invention may have advantages. For example, by minimizing light incident on an outside of the intended light incident region, a light distribution may be improved. Additionally, by making the light incident on an outside of the intended light incident region to be incident on the intended light incident region again, a total flux of light and the light distribution efficiency may be improved.

Embodiments of the present invention may provide an LED based lamp and a method for manufacturing the same that can improve a light distribution.

Embodiments of the present invention may provide an LED based lamp and a method for manufacturing the same that can improve a total flux of light.

An LED based lamp may include a housing (or heat sink) having an LED module provided thereto, a lens unit for inducing a light from the LED module to a defined light incident region, and an adjustor for minimizing light incident to outside of the light incident region.

The adjustor may be provided at a part of the lens unit corresponding to a boundary of the light incident region. The lens unit may include a lens and a window around a circumference of the lens. The adjustor may be provided at a part that includes a boundary of the lens and the window.

The adjustor may be a plurality of uneven parts. The uneven parts may have a surface roughness determined to minimize reduction of total flux of light from the lens unit. The surface roughness of the uneven parts may be a few tens of microns. The uneven parts may be provided on at least one of a front surface and a rear surface of the lens unit.

The adjustor may have light transmissivity lower than other parts of the lens unit. The adjustor may not transmit light. The adjustor may actually reflect the light.

The adjustor may cause irregular reflection of the light. The adjustor may cause total reflection of the light.

The adjustor may be formed as one unit with the lens unit.

A method for manufacturing an LED based lamp may include determining a lens unit to induce a light from an LED module to a defined light incident region, and adjusting for minimizing the light incident to outside of the light incident region. The adjusting may include making a surface roughness of a predetermined part of the lens unit different from the other part of the lens unit. The adjusting may also include making light transmissivity of a predetermined part of the lens unit different from the other part of the lens unit.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A light emitting diode (LED) based lamp comprising:

a heat sink having a receiving part;

a LED module having at least one LED to provide light, the LED module provided in the receiving part of the heat sink;

a lens to receive the light from the LED and to guide the light to a specific area away from the LED based lamp, the lens unit including a lens having a hollow part for providing the LED therein an outer circumference surface that is a sloped surface with a predetermined curvature for making a reflection of the light and a window around a circumference of the lens, wherein the lens projects toward the LED module;

a reflector disposed between the lens unit and the LED module, the reflector to surround the outer circumference surface of the lens for reflecting the light;

an adjustor on the lens outer circumference of the lens to minimize light from being transmitted to a region outside of the specific area;

an electric unit for transforming external power to a power to be used for the LED module;

a housing for housing the electric unit, the housing including fastening bosses; and a fastening member to couple the heat sink to the fastening bosses of the housing by passing through the receiving portion of the heat sink, wherein the adjustor has one of a different surface roughness than an inner area of the surface of the lens or a different light transmissivity than the inner area of the surface of the lens, wherein the adjustor is provided at a boundary of the lens and the window, wherein the lens unit and the reflector are coupled to the heat sink by a covering.

2. The LED based lamp of claim 1, wherein the adjustor is ring-shaped.

3. The LED based lamp of claim 1, wherein the adjustor includes a plurality of uneven parts.

4. The LED based lamp of claim 3, wherein the uneven parts are provided on a front surface of the lens or on a rear surface of the lens.

5. The LED based lamp of claim 1, wherein the surface roughness of the adjustor is greater than the surface roughness of the inner area of the surface of the lens.

6. The LED based lamp of claim 1, wherein the light transmissivity of the adjuster is less than the light transmissivity of the inner area of the surface of the lens.

7. The LED based lamp of claim 1, wherein the adjustor is configured to substantially reflect the light.

8. The LED based lamp of claim 1, wherein the adjustor is configured to cause irregular reflection of the light.

9. The LED based lamp of claim 1, wherein the adjustor is configured to cause total reflection of the light.

10. A light emitting diode (LED) based lamp comprising:

a heat sink having a receiving part;

a LED module having at least one LED in the receiving part;

a lens unit having a lens and a window, the lens to guide the light to a specific area away from the LED based lamp, the lens including a hollow part to receive the LED, the hollow part including an edge, and wherein the lens has a sloped surface that slopes from the edge of the hollow part to the window so as to provide a curvature, and the window is an outward extension from a circumference of the lens;

a reflector disposed between the lens unit and the LED module, the reflector provided at an outer circumference surface of the lens for reflecting the light, wherein the lens unit and the reflector are coupled to the heat sink by a covering;

an adjustor on a front surface of the lens unit to minimize light from being transmitted to a region outside of the specific area, wherein the adjustor has a different surface roughness than an inner surface of the lens;

an electric unit to transform external power to a power to be used for the LED module;

a housing to house the electric unit, the housing including fastening bosses; and a fastening member to couple the heat sink to the fastening bosses by the fastening member being provided through the receiving portion of the heat sink.

11. The LED based lamp of claim 10, wherein the adjustor is provided at a boundary of the lens and the window.

12. The LED based lamp of claim 10, further comprising a refractor on the sloped surface of the lens.

13. The LED based lamp of claim 10, wherein the front surface of the lens unit is a microlens array.

14. The LED based lamp of claim 10, wherein the adjustor is ring-shaped.

15. The LED based lamp of claim 10, wherein the adjustor includes a plurality of uneven parts, and the uneven parts of the adjustor are provided on the front surface of the lens unit.

16. The LED based lamp of claim 10, wherein the surface roughness of the adjustor is greater than the surface roughness of the inner surface of the lens.

17. The LED based lamp of claim 10, wherein a light transmissivity of the adjuster is less than a light transmissivity of the inner surface of the lens.

* * * * *